US006239542B1

(12) United States Patent
Dekker et al.

(10) Patent No.: US 6,239,542 B1
(45) **Date of Patent: *May 29, 2001**

(54) CATHODE RAY TUBE HAVING AN ELECTRON GUN WITH MAGNETIC ELEMENTS

(75) Inventors: Martijn J. Dekker; Leendert J. Noordermeer, both of Eindhoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/307,155

(22) Filed: May 7, 1999

(30) Foreign Application Priority Data

May 11, 1998 (EP) ..... 98201524

(51) Int. Cl.[7] ..... H01J 29/50
(52) U.S. Cl. ..... 313/412; 313/414; 313/431
(58) Field of Search ..... 313/431, 412, 313/413, 414

(56) References Cited

U.S. PATENT DOCUMENTS

| | | | | |
|---|---|---|---|---|
| 3,772,554 | * | 11/1973 | Hughes | 313/69 C |
| 4,546,287 | * | 10/1985 | Collins et al. | 313/414 |
| 4,748,372 | | 5/1988 | Noordermeet | 313/413 |
| 5,530,315 | * | 6/1996 | Arimoto et al. | 313/431 |

* cited by examiner

*Primary Examiner*—Nimeshkumar D. Patel
*Assistant Examiner*—Karabi Guharay

(57) ABSTRACT

A cathode ray tube comprises an electron gun for generating electron beams. External magnetic fields influence the electron beams and reduce the picture quality. An electrode of the gun includes a part of a soft-magnetic material, which extends transversely to the electron beams, and two parts, situated to the left and to the right of the electron beams, which extend along the electron beams. Together these parts form a magnetic circuit. Preferably, these parts are strongly magnetically coupled, for example, because they are interconnected or very closely spaced. Interaction of the magnetic circuit formed by the three parts with an external magnetic field causes a Lorentz force on the electron beams. The resultant deviations in the paths of the electron beams largely compensate for the deviations in the paths of the electron beams caused by the effect of the external magnetic field between the electron gun and the display screen.

13 Claims, 5 Drawing Sheets

CATHODE RAY TUBE HAVING AN ELECTRON GUN WITH MAGNETIC ELEMENTS

BACKGROUND OF THE INVENTION

The invention relates to a cathode ray tube comprising an in-line electron gun including means for generating electron beams and electrodes.

Such cathode ray tubes are known and are employed, inter alia, in television receivers and computer monitors.

In such a cathode ray tube, three electron beams are generated in the in-line electron gun, which electron beams extend in one plane, the in-line plane. These electron beams are deflected across a display screen in two mutually perpendicular directions by means of a deflection means. A color selection electrode, for example a shadow mask, is arranged between the electron gun and the display screen.

A factor which is of great importance for the quality of the image displayed is the accuracy with which the three electron beams converge. Convergence errors adversely affect the picture quality.

An external magnetic field (for example the terrestrial field) influences the electron beams and hence may cause convergence errors and adversely affect the picture quality.

OBJECT AND SUMMARY OF THE INVENTION

It is an object of the invention to provide a cathode ray tube comprising a means for improving the picture quality.

To achieve this, a cathode ray tube in accordance with the invention is characterized in that the electron gun comprises an electrode including: a part which comprises a soft-magnetic material, which extends at least partly transversely to the paths of the electron beams, and which is provided with apertures for allowing passage of the electron beams, and two further parts comprising a soft-magnetic material, which extend substantially parallel to the electron beams and on either side of said electron beams, and which parts are further removed from the means for generating the electron beams than the first-mentioned part.

An external magnetic field causes, in an in-line gun, two effects which both bring about a convergence error in the y-direction (transversely to the in-line plane through the three electron beams) and which are both approximately of the same order of magnitude. The overall effect is the sum of both effects.

In the cathode ray tube in accordance with the invention, the electron gun comprises parts of a soft-magnetic material which jointly form a, preferably continuous, magnetic circuit which extends both along and transversely to the electron beams. By virtue thereof, as a result of an interaction of the external magnetic field and the magnetic circuit, an additional force can be generated, in operation, which acts on the outermost electron beams and which causes the error in the y-direction to be reduced. It is important that the electron beams first pass the part having the apertures, at right angles to the electron beams, and subsequently the further parts parallel to the electron beams. Preferably, the parts lie against each other or substantially against each other, or are connected to each other. Preferably, the part and further parts are situated in front of a main lens (viewed from the means for generating electron beams) and the part and further parts form a portion of a focusing electrode.

These and other aspects of the invention will be apparent from and elucidated with reference to the embodiments described hereinafter.

BRIEF DESCRIPTION OF THE DRAWINGS

In the drawings.

The Figures are not drawn to scale. In the Figures, like reference numerals generally refer to like parts.

DESCRIPTION OF THE PREFERRED EMBODIMENTS

Figure 1:
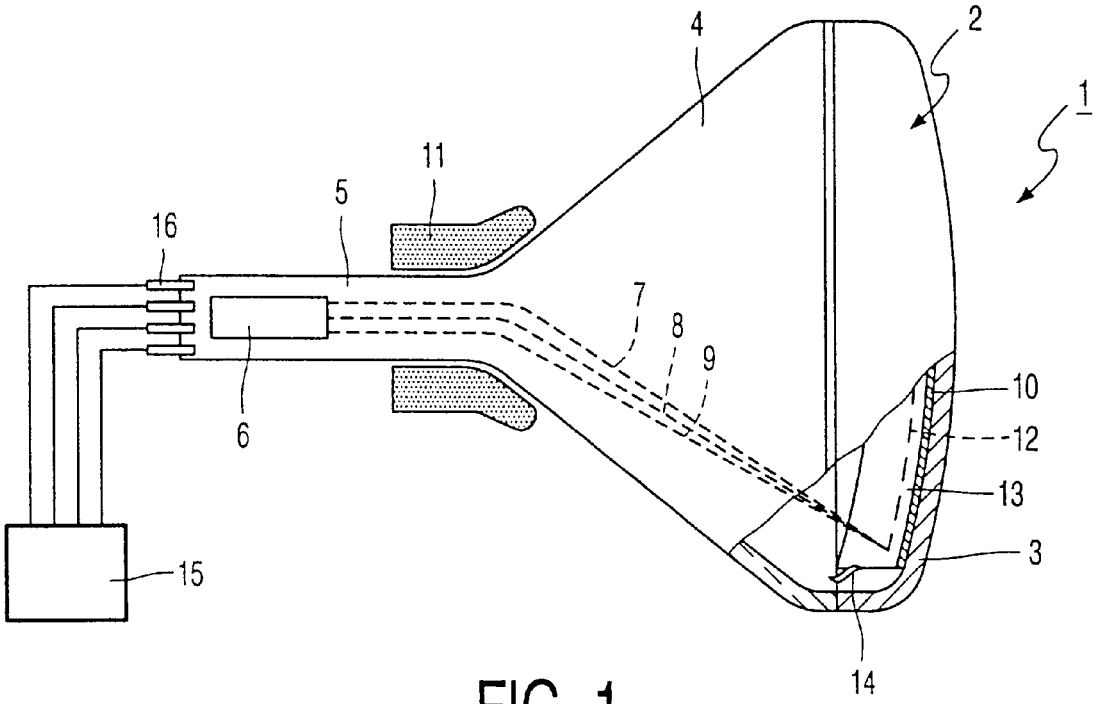
FIG. 1 is a sectional view of a cathode ray tube.

A cathode ray tube in this example a color display tube, comprises an evacuated envelope which includes a display window a cone portion and a neck 5. Said neck 5 accommodates an electron gun 6 for generating three electron beams 7, 8 and 9 extending in one plane, the in-line plane, which in this case is the plane of the drawing. In the undeflected state, the central electron beam 8 substantially coincides with the tube axis. A display screen 10 is situated on the inner surface of the display window. Said display screen 10 comprises a large number of phosphor elements luminescing in red, green and blue. On their way to the display screen, the electron beams are deflected across the display screen 10 by means of an electromagnetic deflection unit 11 and pass through a color selection electrode 12 which is arranged in front of the display window 2 and which comprises a thin plate with apertures 13. The three electron beams 7, 8 and 9 pass through the apertures 13 of the color selection electrode at a small angle with respect to each other and hence each electron beam impinges only on phosphor elements of one color. In operation, also means 15 are coupled to the cathode ray tube, which means serve to generate voltages, which they supply, via feedthroughs 16, to parts of the electron gun.

Figure 2:
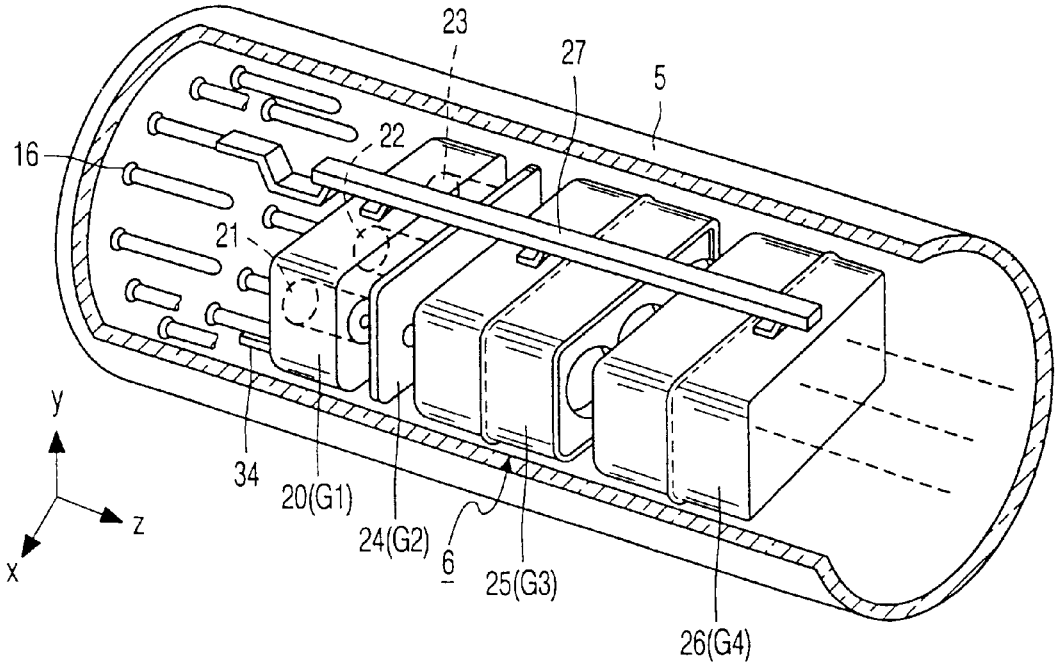
FIG. 2 shows an electron gun of the cathode ray tube shown in FIG. 1.

FIG. 2 is a view of an electron gun 6. Said electron gun comprises three cathodes 21, 22 and 23. The electron gun further includes a first common electrode 20 ($G_1$), a second common electrode 24 ($G_2$), a third common electrode 25 ($G_3$) and a fourth common electrode 26 ($G_4$). The electrodes have connections for applying electric voltages. The display device comprises supply lines, not shown, for supplying electric voltages generated in the means 15 to the electrodes. Electron-optical fields are generated by applying electric voltages, in particular by differences in electric voltages between electrodes and/or sub-electrodes. Electrodes 26 ($G_4$) and sub-electro 25 ($G_3$) form an electron-optical element for generating a main lens field which, in operation, is formed between these electrodes. The electrodes are interconnected by means of connection elements, in this example glass rods 27.

Figure 3:
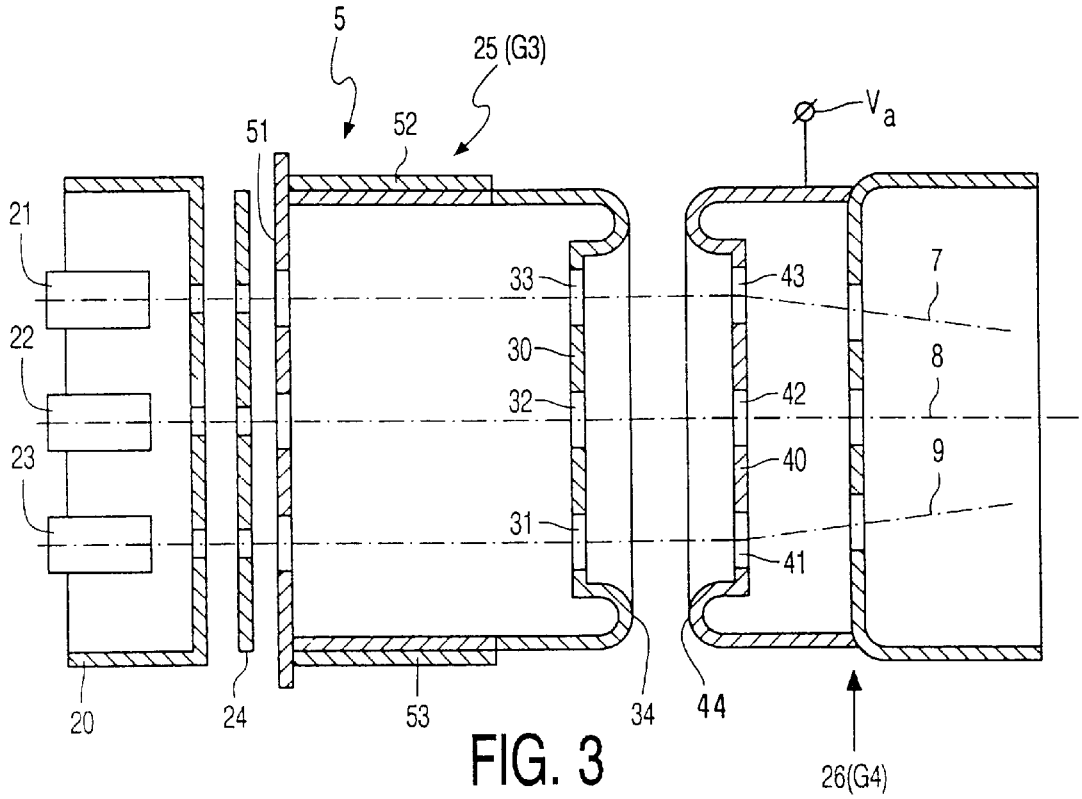
FIG. 3 is a sectional view of an electron gun.

FIG. 3 is a schematic, sectional view of the electron gun shown in FIG. 2. In this example, the electrodes 25 ($G_3$) and 26 ($G_4$) each comprise plates 30 and 40, provided with apertures 31, 32, 33 and 41, 42, 43, respectively. These plates are arranged so as to be recessed relative to the outside edges or collars 34 and 44 of the electrodes 25 and 26. The electrode 25 ($G_3$) comprises a part 51 which is made of a soft-magnetic material and which extends transversely to the paths of the electron beams, said part being provided with apertures for allowing passage of electron beams. The electrode 25 further comprises two further parts 52 and 53 which are made of a soft-magnetic material and which extend substantially parallel to the electron beams, on either side of said electron beams, and, in this example, transversely to the part 51, whereby the part and the two further parts are interconnected, lie against each other or substantially against each other, and the further parts 52 and 53 are further removed from the means for generating the electron beams (in this example cathodes 21, 22 and 23) than the part 51. Before passing the parts 52 and 53, the electron beams pass the part 51.

Figure 4:
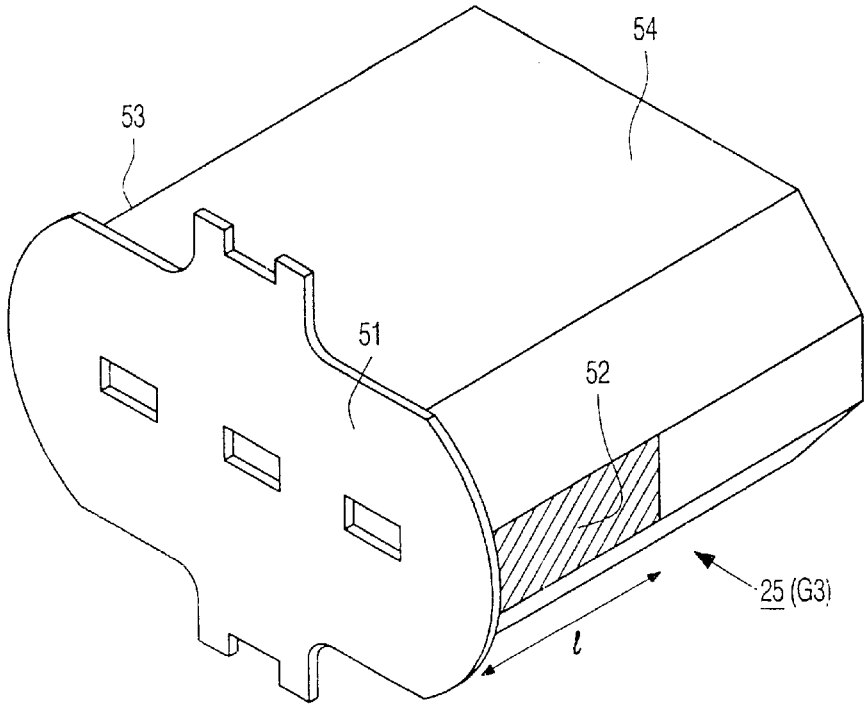
FIG. 4 is a perspective view of a part of an electrode for an electron gun for a cathode ray tube in accordance with the invention.

FIG. 4 is a perspective view of a part of electrode 25. Parts 51, 52 and 53 (not visible in this drawing) are made of a soft-magnetic material. Said parts 51, 52 and 53 form a continuous magnetic circuit. The electrode further includes a substantially tubular part 54 which is made of a non-magnetic material.

In an in-line gun, an external, axial magnetic field leads to two effects which both cause a convergence error in the y-direction (a direction transverse to the plane through the electron beams). The product of the velocity component in the x-direction of the outermost electron beams 7, 9 and the field component in the axial direction (along the tube axis, or z-direction) causes a Lorentz force in the y-direction on the outermost electron beams. In addition, metal parts of or situated around the cathode ray tube, particularly a magnetic shielding cover, cause deformation of the magnetic field. This gives rise to an x-component in the magnetic field, which together with the z-component of the velocity of the electron beams also gives rise to a component of a Lorentz force in the y-direction. In a cathode ray tube, these two effects are of the same magnitude and strengthen one another. The Lorentz forces cause a convergence error in the y-direction of typically several hundred micrometers. This error can be compensated for by introducing an additional field which introduces a convergence error of substantially the same magnitude as the convergence error caused by the external field, yet of opposite sign. Consequently, both convergence errors counteract each other substantially or completely.

Such a field can be generated by employing a number of soft-magnetic parts which extend both transversely to and along the electron beams and which jointly form a continuous magnetic circuit. In this respect, it is important that the part extending, either partly or integrally, transversely to the electron beams is situated (viewed in the direction of propagation of the electron beams) in front of the parts extending along the electron beams. In this case, the compensating field is of the proper sign. Preferably, the parts are magnetically short-circuited. To achieve this, the parts preferably lie against each other or substantially against each other, or are interconnected.

A number of embodiments of an electrode for a cathode ray tube in accordance with the invention include:

1) if a tubular electrode is entirely made of a non-magnetic material, the plate with apertures situated on the front side of the electrode may be made of a soft-magnetic material (for example NiFe) and strips of a soft-magnetic material (for example NiFe) may be secured to the tubular part of the electrode. This is schematically shown in FIG. 4.

2) if an electrode is composed of two parts (see FIG. 5), the first part 61 may be made of a soft-magnetic material and the second part 62 of a non-soft-magnetic material. Two elements 63 and 64 of a soft-magnetic material are secured on either side (east and west) on part 62. Preferably, they partly overlap (viewed in the direction of propagation of the electron beams (the z-direction) ) part 62 so as to bring about a good magnetic coupling between the parts 62, 63 and 64. the parts 52 and 53 may be slightly curved so as to optimally follow the shape of the non-soft-magnetic part of the electrode (see FIG. 6).

As regards the design, shown in FIG. 4, as a function of the length of the parts 52 and 53, and the distance between the parts 51 and 52, 53, calculations give the results listed hereinbelow, whereby the change in astigmatism is calculated in the center of the display screen at a change of an axial magnetic field of 0.8 Gauss:

| length 1 (mm) | distance (mm) | astigmatism external field | astigmatism as a result of 51, 52, 53 | astigmatism |
|---|---|---|---|---|
| 16.2 | 0.0 | 280 μm | −510 μm | −240 μm |
| 8.1 | 0.0 | 280 μm | −280 μm | 0 μm |
| 8.1 | 0.1 | 280 μm | −190 μm | 90 μm |
| 8.1 | 0.2 | 280 μm | −160 μm | 120 μm |

The column "astigmatism external field" indicates the deviations in the position of the outermost electron beams on the display screen as a result of the change in intensity of the external field by 0.8 Gauss. This change is brought about by Lorentz forces on the electron beams between the means for generating and the display screen. The column "astigmatism as a result of 51, 52 and 53" gives the deviations in the position of the outermost electron beams on the display screen as a result of the change in intensity of the field generated in the magnetic circuit formed by the parts upon a change in intensity of the external field of 0.8 Gauss. This change is opposed to the change shown in the column "astigmatism external field". Consequently, the two deviations cancel each other substantially or completely.

The Table shows that for parts 52 and 53 having a length of 8 mm and making contact with part 51, the effect of a change in the external magnetic field is canceled by the effect of the magnetic circuit formed by the parts 51 through 53. The distance between the parts is also important in this respect. A slit of 0.2 mm between the parts 52, 53 and part 51 noticeably reduces the compensating effect. Apart from the fact that a good compensation would require the parts 52 and 53 to be lengthened (which may be difficult to realize), this also means that a spread in compensation may occur. A small variation in the slit size means a fairly large variation in the compensating effect. For this reason, there is preferably good (magnetic) contact between the parts.

Calculations have shown that it is the combination of the parts 52, 53 and 51 which leads to the proper compensating effect. The use of only the parts 52 and 53 does not lead to a compensating effect.

Measurements have shown that parts 52 and 53 with a length of 6 and 8 mm (and a width of 10 mm) indeed exhibit the desired effect. The measured remaining astigmatism errors were −10 μm (for a length of 6 mm) and −20 μm (for a length of 8 mm). The length of the parts 52 and 53 preferably ranges between 5 and 12 mm. This enables a good compensating effect to be achieved while the length of the parts is not such that the electrodes must be lengthened.

Figure 5:
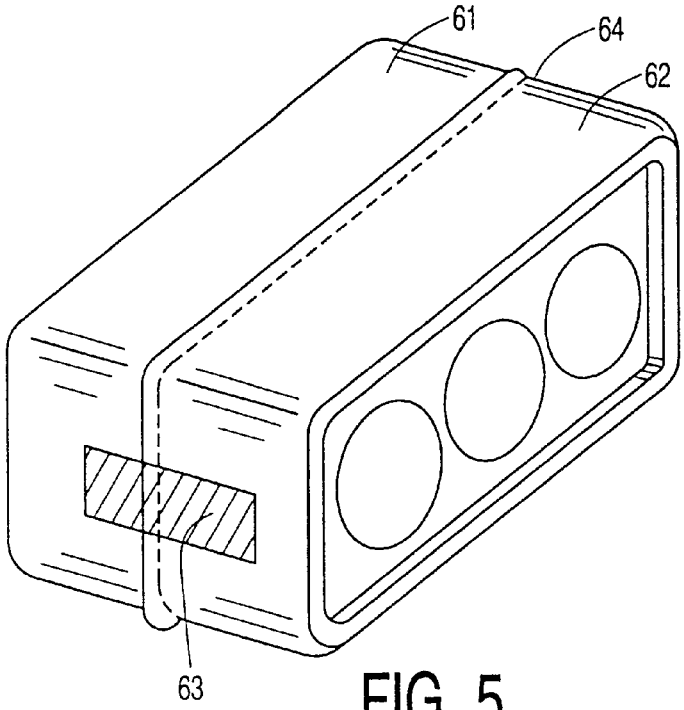
FIG. 5 is a perspective view of an electrode for an electron gun for a cathode ray tube in accordance with the invention.
Figure 6:
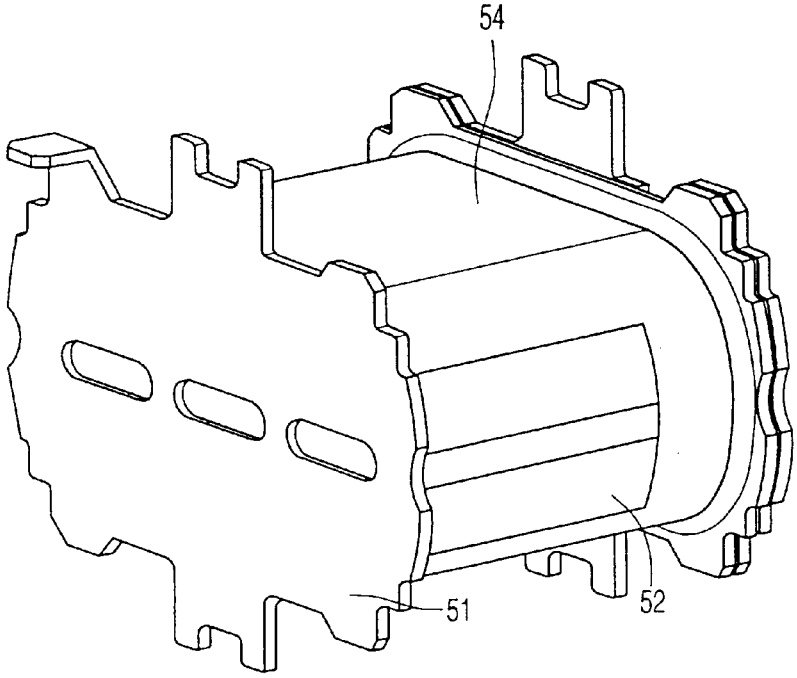
FIGS. 6 and 7 are perspective views of further examples of an electrode for an electron gun for a cathode ray tube in accordance with the invention.

The embodiments shown in FIGS. 5 and 6 yield comparable results.

Preferably, the part 51 (61) is situated in front of the main lens and is, for example, the front side of a focusing electrode. This part may be (in less preferred embodiments) the front side of another electrode, for example the anode or the centering bush, but preferably the soft-magnetic materials are not situated in the direct surroundings of the main lens (owing to high-voltage problems) and not in the deflection field. The anode is situated in the direct surroundings of the main lens and the centering bush is close to the deflection field.

Figure 7:
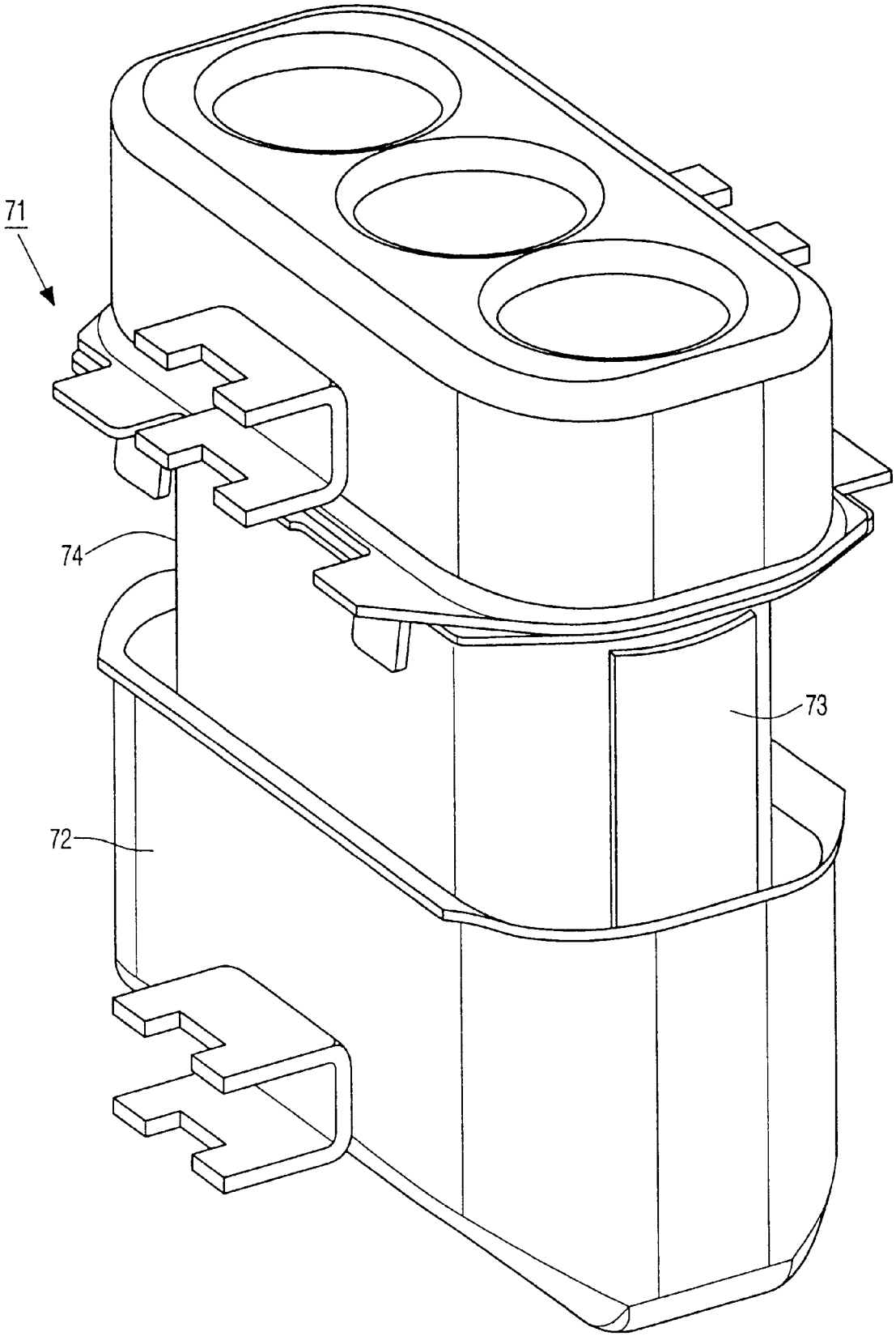
Figure 8:
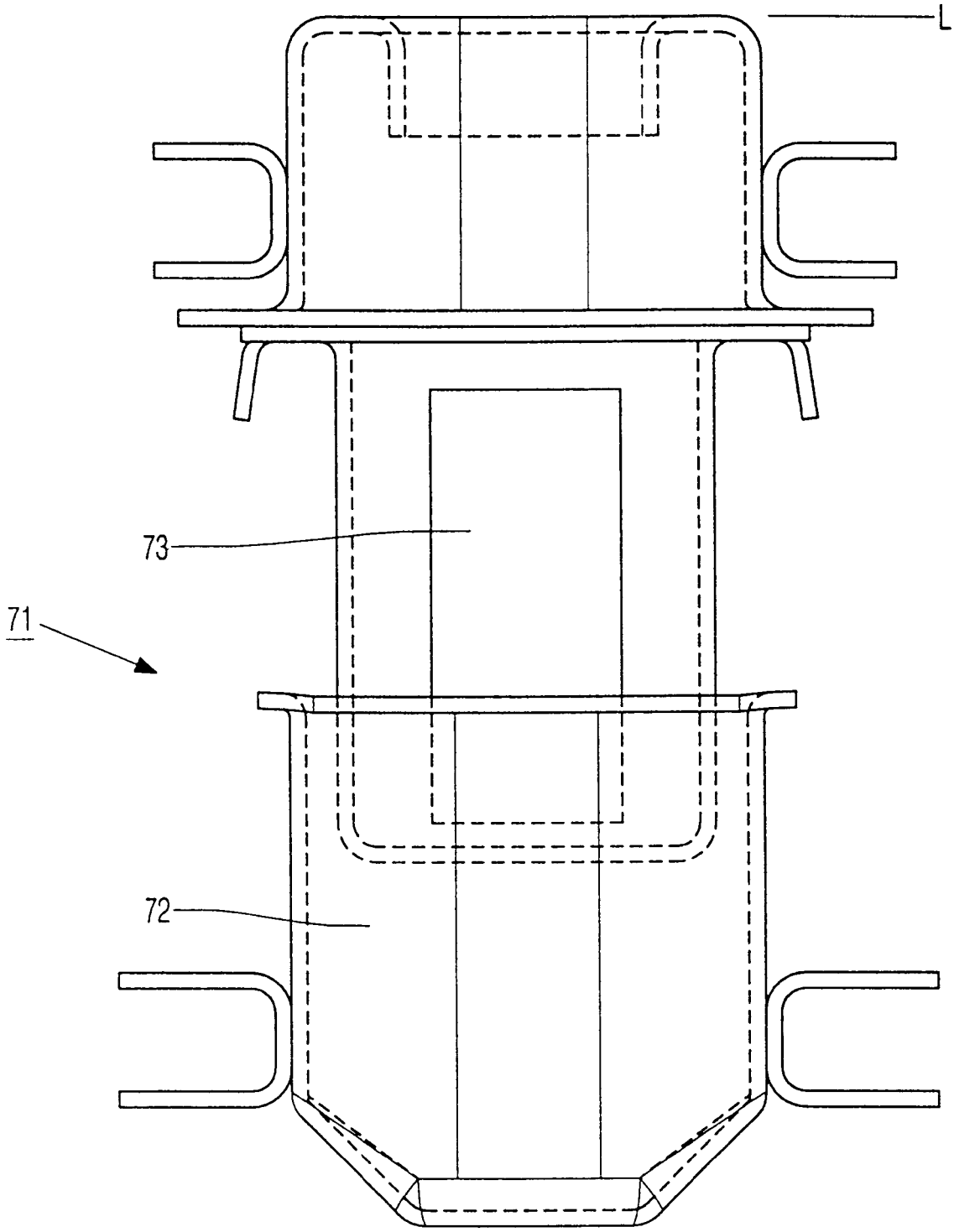
FIG. 8 is a side view of the electrode shown in FIG. 7.

It will be obvious that within the scope of the invention many variations are possible. For example, a further embodiment is shown in FIG. 7. FIG. 7 shows a perspective view of a focusing electrode 71. This focusing electrode comprises, at the end facing the means for generating, a part 72 of a soft-magnetic material and two further parts 73 and 74 which are also made of a soft-magnetic material. FIG. 8 shows a side view of the electrode shown in FIG. 7. The part 73 partly overlaps part 72 to bring about the magnetic coupling between the parts 72 and 73. The main lens L is formed between the electrode 71 and the anode, which is not shown in this drawing.

The invention can be summarized as follows:

A cathode ray tube comprises an electron gun with means for generating electron beams. External magnetic fields influence the electron beams and reduce the picture quality. An electrode of the gun includes a part made of a soft-magnetic material which extends transversely to the electron beams and two parts, situated to the left and to the right of the electron beams, which extend along said electron beams. Together these parts form a magnetic circuit. Preferably, these parts are magnetically coupled, for example, because they are interconnected or very closely spaced. A good magnetic coupling can also be achieved if the parts partly overlap each other (as shown, for example, in FIGS. 7 and 8). The further parts are farther removed from the electron-generating means than the first part but, viewed in the z-direction (along the electron beams) or in the x-y plane, the parts may partly overlap each other. Interaction of the magnetic circuit formed by said three parts with an external magnetic field causes a Lorentz force on the electron beams. The resultant deviations in the paths of the electron beams largely compensate for the deviations in the paths of the electron beams caused by the effect of the external magnetic field between the electron gun and the display screen.

What is claimed is:

1. A cathode ray tube comprising an in-line electron gun including means for generating electron beams and electrodes, wherein the electron gun comprises an electrode including:

a first member comprising a soft-magnetic material, which first member extends at least partly transversely to the paths of the electron beams, and which is provided with apertures for passage of the electron beams, a tubular member formed of a non-magnetic material, and second and third members comprising a soft-magnetic material, which second and third members each extend substantially parallel to the electron beams at least partly along said tubular member and are respectively disposed on opposite sides of said electron beams, and which second and third members are further removed from the means for generating the electronic beams than the first member, a region along said tubular member between said second and third members being free from soft-magnetic material.

2. A cathode ray tube as claimed in claim 1, wherein the first member and each of the second and third members are joined to each other, contact each other or substantially contact each other.

3. A cathode ray tube as claimed in claim 1, wherein the first member and the second and third members are situated in front of a main lens.

4. A cathode ray tube as claimed in claim 1, wherein the second and third members each have a length ranging from 5 to 12 mm.

5. A cathode ray tube as claimed in claim 1, wherein said second and third members are strips secured to said tubular member.

6. A cathode ray tube comprising:

an in-line type electron gun for generating electron beams; and a bulb having a neck tube enclosing the in-line type electron gun, wherein the electron gun comprises electron beam generating means, a first member comprised of soft-magnetic material and extending transverse to the paths of the electron beams and having apertures to allow passage of the electron beams, a tubular member formed of a non-magnetic material, and second and third members comprised of soft-magnetic material and extending substantially parallel to the electron beams at least partly along said tubular member and respectively on either side of said electron beams, wherein the second and third members are further removed from the electron beam generating means than the first member, and wherein the first, second and third members form a magnetic circuit, a region along said tubular member between said second and third members being free from soft-magnetic material.

7. The cathode ray tube of claim 6, wherein the first member contacts each of the second and third members.

8. The cathode ray tube of claim 6, wherein three electron beams are generated.

9. The cathode ray tube of claim 6, wherein said second and third members are strips secured to said tubular member.

10. An in-line type electron gun for generating electron beams comprising electron beam generating means, a first member comprised of soft-magnetic material and extending transverse to the paths of the electron beams and having apertures to allow passage of the electron beams, a tubular member formed of a non-magnetic material, and second and third members comprised of soft-magnetic material and extending substantially parallel to the electron beams at least partly along said tubular member and respectively on either side of said electron beams, wherein the second and third members are further removed from the electron beam generating means than the first member, and wherein the first, second and third members form a magnetic circuit, a region along said tubular member between said second and third members being free from soft-magnetic material.

11. The in-line type electron gun of claim 10, wherein the first member contacts each of the second and third members.

12. The in-line type electron gun of claim 10, wherein three electron beams are generated.

13. The in-line type electron gun of claim 10, wherein said second and third members are strips secured to said tubular member.

* * * * *